US006354080B1

(12) United States Patent
Decker

(10) Patent No.: US 6,354,080 B1
(45) Date of Patent: Mar. 12, 2002

(54) AIR POWERED HYDRAULIC JACK WITH STATIC LINE AIR PRESSURE SHIFT CONTROL

(75) Inventor: Arnold F. Decker, Aurora, IL (US)

(73) Assignee: Templeton, Kenly & Co., Inc., Broadview, IL (US)

( * ) Notice: Subject to any disclaimer, the term of this patent is extended or adjusted under 35 U.S.C. 154(b) by 0 days.

(21) Appl. No.: 09/532,227

(22) Filed: Mar. 22, 2000

(51) Int. Cl.[7] ..... F15B 21/02
(52) U.S. Cl. ..... 60/412; 173/2
(58) Field of Search ..... 60/433, 412; 173/2, 173/11

(56) References Cited

U.S. PATENT DOCUMENTS 4,251,055 A 2/1981 Leong et al.
4,889,472 A 12/1989 Decker et al.
5,782,158 A * 7/1998 Rothering ..... 91/98
5,993,146 A * 11/1999 Hallgren ..... 414/792.2

* cited by examiner

*Primary Examiner*—Edward K. Look
*Assistant Examiner*—Thomas E. Lazo
(74) *Attorney, Agent, or Firm*—Michael Best & Friedrich LLP

(57) ABSTRACT

An air powered hydraulic lift system including a hydraulic pump operably connected to the ports of a hydraulic lifting cylinder, the hydraulic pump being driven by an air motor, an air pressure pilot operated valve for controlling supply of hydraulic fluid from the hydraulic pump to the ports of the hydraulic cylinder and an air pressure control valve connected to the air motor and to the air pressure pilot operated valve to supply air pressure to the air motor when air is supplied to the air pressure pilot operated valve.

9 Claims, 1 Drawing Sheet

AIR POWERED HYDRAULIC JACK WITH STATIC LINE AIR PRESSURE SHIFT CONTROL

FIELD OF THE INVENTION

The invention relates to hydraulic lift systems and more particularly to controls for effecting actuation of such systems.

BACKGROUND PRIOR ART

In hydraulic lift systems it is advantageous in some applications to use an air pressure driven motor to drive a hydraulic fluid pump which selectively supplies hydraulic fluid pressure to the hydraulic cylinder of the hydraulic lift system. An example of a prior art arrangement is illustrated in U.S. Pat. No. 4,251,055. Attention is also directed to U.S. Pat. No. 4,889,472.

In some prior art hydraulic lift systems the air motor is connected to the air supply such that it continues to run in neutral even when the hydraulic pump is not called on to supply hydraulic fluid to the lift cylinder. The air supplied to the air motor is vented to atmosphere and this results in a decrease in the air pressure in the air supply line. The hydraulic system control valve includes air pressure actuated pilot valves connected to the air supply line.

SUMMARY OF THE INVENTION

In operation of air powered hydraulic lift systems, it is common to use a hydraulic control valve which is a three position, four-way air piloted valve. When such a valve is actuated to cause operation of the lift cylinder and the lift cylinder is placed under load, the combination of the hydraulic fluid pressure in the valve and the hysteresis of the valve, may be too great to be overcome by the pilot air pressure if the air pressure in the supply line is less than a predetermined air pressure. The invention provides a hydraulic lift system including a control circuit design that uses a pilot to open an in-line air flow control valve with a dual circuit separation shuttle valve to allow sequenced operation of the control valve that changes the hydraulic fluid flow to extend or retract the cylinder component of the hydraulic lift.

The in-line valve opens when it receives a pilot signal to allow air flow to the air motor that powers the hydraulic pump. The signal comes from an air supply that is directed to the in-line valve from either side of the air control circuit used to power the four-way hydraulic valve. The air signal is controlled manually via a hand held pendant control used by the operator to send air pressure to shift the valve to advance or retract positions. The pendant is a manifold block that houses two three-way push button air valves. In operation of the hydraulic lift system, the operator opens the main air supply valve. This supplies air to a control pendant and in-line valve. The operator depresses either of the two manual air valve buttons. The air supply is delivered to the air control pilot on one side of the hydraulic valve as well as the pilot piston on the in-line valve. The hydraulic valve shifts and the in-line valve opens to cause the air supply to be allowed to reach the air motor thereby turning the hydraulic pump to supply hydraulic fluid to the hydraulic valve and the lift. The shuttle valve separates the two sides of the air pilot control circuit so that the pilot signal can come to the in-line valve from either side of the circuit without letting the signal bleed across to the pilot circuit on the opposite side of the hydraulic valve. When the operator releases the button on the pendant, the control valve returns to a neutral position and the in-line air valve closes stopping the pump. This action provides for a deadman control of the hydraulic lift.

One of the advantages derived from the control circuit arrangement is improved shifting performance of the valve. When the air motor runs, the air line supply pressure drops due to the fact that the air supply lines typically used provide a relatively small volume of air to the air motor. When the air motor is not controlled in some sequence of operation by the hydraulic valve, the air pressure that is left with the air motor running may not be enough to operate and overcome the hysteresis of the hydraulic valve. Additionally, the action of the hydraulic valve may become erratic allowing the valve to shift under lower hydraulic pressures but not at higher pressures. This may result in a variety of jack malfunctions with the most common one being a jack that will raise a load but wherein difficulties are experienced in lowering the load.

With the additional controls provided by the present invention, the air control activates from the static air line supply pressure, which is typically higher than the air line pressure when the motor is running. This insures that the control valve has enough air pressure to shift before the air motor starts. The in-line valve also functions to throttle the air to the air motor which helps maintain a predetermined air control pressure in the air control circuit. When the air pressure drops too low, the in-line valve loses the pilot signal required to maintain the valve open. As it closes, it limits the air consumed by the air motor thereby maintaining the air supply at the level required by the demand.

DESCRIPTION OF A PREFERRED EMBODIMENT

Figure 1:
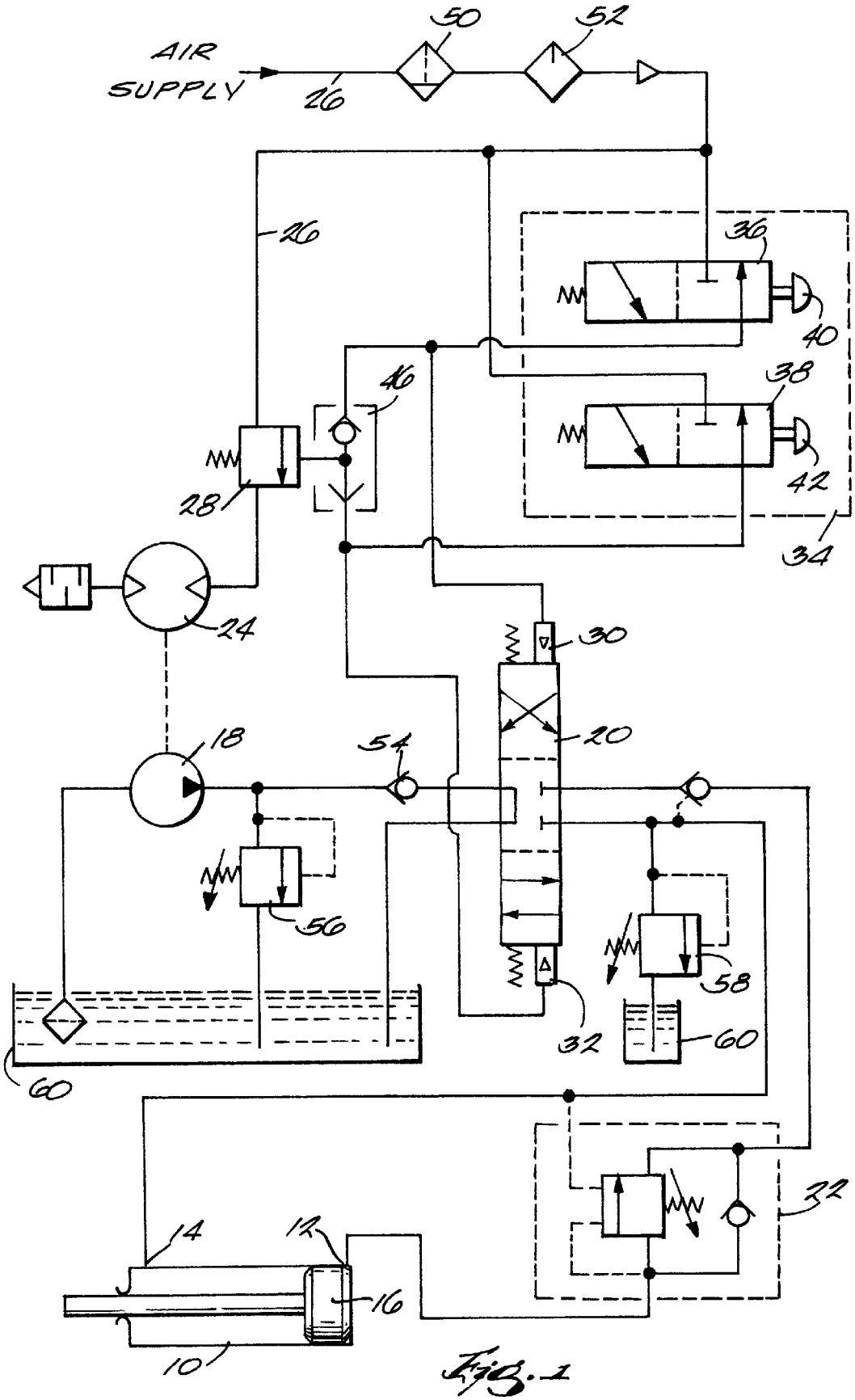
FIG. 1 is a schematic view of an air powered hydraulic lift system embodying the invention.

Illustrated in FIG. 1 is a lift cylinder 10 which in one preferred form of the invention can be a hydraulic cylinder. In the illustrated arrangement, the lift cylinder 10 has ports 12 and 14 and an extensible piston 16. A fluid pump 18 is connected to the ports 12 and 14 of the cylinder 10 through a control valve 20. The control valve 20 can be a three position, four-way air piloted valve. In a preferred form of the invention a load holding valve 22 is provided in fluid connection between the ports 12 and 14 and the control valve 20. The load holding valve 22 provides controlled or balanced discharge of fluid from the cylinder 10 when the cylinder is loaded. The load holding valve 22 is conventional in its construction and the specific arrangement of components making up the load holding valve 22 is not part of the present invention.

An air motor 24 is operably connected to the hydraulic pump 18 to selectively drive the hydraulic pump 18 when the air motor 24 is operated. A suitable air motor and hydraulic pump are illustrated in Applicant's U.S. Pat. No. 4,251,055 and 4,884,472. The air motor 24 is also operably connected to a suitable source of air pressure, such as a conventional air line 26, through an in-line normally closed pilot operated air valve 28.

In a preferred form of the invention, the three position, four-way valve 20 is a spring centered air pressure pilot operated valve. The pilots 30 and 32 at opposite ends of the spool of the three position, four-way valve 20 are connected to the air supply 26 through an air pendant control 34. The air pendant control 34 includes a pair of manually operated two position, three-way air valves 36 and 38, respectively connected to the pilots 30 and 32 of the three position, four-way hydraulic valve 20. Each of the manually operated two position, three-way air valves 36 and 38 are spring biased to a normally closed position and are manually actuated by a plunger or buttons 40 and 42 to the open position. In operation, manual actuation of the plunger 42 by the operator will supply air pressure to the pilot 32 to cause the spool of the valve 20 to move to a position where hydraulic fluid is supplied from the pump 18 through the load holding valve 22 to port 12 of the hydraulic cylinder 10 to thereby cause extension of the piston 16 of the hydraulic cylinder.

Actuation of the plunger 40 will supply air pressure to the other pilot 30 of the three position, four-way hydraulic valve 20, to shift the valve spool of that valve to cause supply of hydraulic fluid to the port 14 of the cylinder 10 and retraction of the piston 16.

A shuttle valve 46 is also connected between air pendant control 34 and the two position, two-way air valve 28 and functions to alternatively supply air pressure to the pilot of the in-line normally closed air valve 28 from either of the two, three-way air valves 36 or 38 once air is supplied from that valve by depression of the actuator 40 or 42.

In the illustrated arrangement, the air supply line also includes a filter separator 50 and a lubricator 52. The hydraulic circuit also includes a check valve 54 between the pump 18 and the four-way hydraulic valve 20. The hydraulic circuit also includes a main pressure relief valve 56 and a retract pressure relief valve 58 to discharge hydraulic fluid to the tank 60 in the event the hydraulic pressure at the relief valves 56 or 58 exceeds a selected pressure.

In operation of the air powered hydraulic lifting system of the invention, static air pressure is supplied through the air line 26 when the valves 36 and 38 are closed. When the operator depresses the actuator 42 to cause extension of the piston 16 of the hydraulic lifting cylinder 10, that air pressure is supplied to the pilot 32 of the hydraulic valve 20 to shift the spring centered hydraulic valve to an actuating position. At the same time air pressure is supplied through the shuttle valve 46 to the pilot of the in-line normally closed air valve 28 to open the in-line air valve 28. Air is supplied from air line 26 to the air motor, and the air motor 24 in turn drives the hydraulic pump 18.

If the operator releases the plunger 42 of the two position, three-way air valve 38, since that valve is spring biased to a closed position, the valve 36 will close interrupting air supply pressure to the pilot 32 of the hydraulic valve and to the pilot of the in-line air valve 28 and exhaust air pressure from both pilots. The in-line valve 28 is spring biased to a closed position, and accordingly, will close once pilot air pressure is removed and the air motor 24 and hydraulic pump 18 will cease their operation.

When the other plunger 40 is depressed, static air pressure will be supplied to the other pilot 30 of the hydraulic valve 20 to shift the valve spool so as to vent hydraulic fluid from the lifting cylinder 10. At the same time an air pilot signal is supplied through the shuttle valve 46 to the pilot of the in-line air valve 28 to open valve 28 and supply air pressure to the air motor 24. Because the in-line valve interrupts supply of air to the air motor until the actuator 42 of the three-way air valve 38 is depressed, the air pressure supplied to the pilot 30 is effectively static air pressure. This produces a stronger air pressure signal to the pilot 30.

In prior art arrangements where the air pressure supplied to the air motor is continuous, the air pressure experienced by the pilots may be insufficient, and may be ineffective to actuate the hydraulic valve. This effect may be most pronounced when the lifting cylinder is under substantial load and the operator seeks to lower the lift cylinder. The combination of the hysteresis of the valve and the hydraulic fluid pressure experienced by the valve spool due to the load of the lifting cylinder may result in substantial resistance to the movement of the valve spool. The pilot pressure may be insufficient to cause movement of the valve spool and to effect retraction of the piston and lowering of the load. By interrupting supply of air flow to the air motor and thereby providing static pressure to the pilot, the air pressure in the pilot will be sufficient to actuate movement of the valve spool even when there is significant hydraulic fluid pressure in the valve.

I claim:

1. An air powered hydraulic lift comprising:

a hydraulic lift cylinder having a port, a pair of manually operated valves, a hydraulic pump operably connected to the port of the hydraulic lift cylinder, an air pressure pilot operated valve for controlling supply of hydraulic fluid from the hydraulic pump to the port of the hydraulic cylinder, an air driven motor operably connected to the hydraulic pump to selectively drive the hydraulic pump, an air pressure control valve connected to the air driven motor and to the air pressure pilot operated valve, the air pressure control valve supplying air pressure to the air motor when pilot air is supplied to the air pressure pilot operated valve, and a shuttle valve selectively operably connecting alternate ones of the manually operated valves to the air pressure control valve.

2. An air powered hydraulic lift system as set forth in claim 1, and further including a manually operated valve operably connected to the air pressure pilot operated valve, the air pressure control valve being connected to the manually operated valve when air is supplied to the air pressure pilot operated valve.

3. An air powered hydraulic lift system as set forth in claim 1, wherein the air pressure pilot operated valve is an in-line normally closed air piloted valve.

4. An air powered hydraulic lift system as set forth in claim 1, wherein the manually operated valve is a spring biased normally closed valve.

5. A fluid powered lift system comprising:

a fluid actuated cylinder including at least one fluid port, a fluid pump connected to said fluid port, a pair of manually operated valves, a pilot actuated control valve between said fluid pump and said fluid port and for selectively controlling supply of fluid pressure from said fluid pump to said fluid port, a fluid pressure driven motor operably connected to the fluid pump to drive the fluid pump, a fluid pressure control valve connected to the fluid pressure driven motor and to the pilot actuated control valve to supply fluid pressure to the fluid pressure driven motor when fluid pressure is supplied to the pilot actuated control valve, and a shuttle valve selectively operably connecting alternate ones of the manually operated valves to the fluid pressure control valve.

6. A fluid powered lift system as set forth in claim 5, and further including a manually operated valve operably connected to the pilot actuated control valve, the fluid pressure control valve being connected to the manually operated valve when fluid is supplied to the pilot actuated control valve.

7. A fluid powered lift system as set forth in claim 5, wherein the pilot actuated control valve is an in-line normally closed piloted valve.

8. A fluid powered lift system as set forth in claim 5, wherein the manually operated valve is a spring biased normally closed valve.

9. An air powered hydraulic lift comprising:

a hydraulic lift cylinder having a port, a hydraulic pump operably connected to the port of the hydraulic lift cylinder, an air pressure pilot operated valve for controlling supply of hydraulic fluid from the hydraulic pump to the port of the hydraulic cylinder, an air driven motor operably connected to the hydraulic pump to selectively drive the hydraulic pump, and first and second manually operated valves that are connected to the air driven motor and to the air pressure pilot operated valve, the first manually operated valve being selectively operable to supply air to the air driven motor and pilot air to the air pressure pilot operated valve to extend the hydraulic lift, the second manually operated valve being selectively operable to supply air to the air driven motor and pilot air to the air pressure pilot operated valve to retract the hydraulic lift.

* * * * *